United States Patent [19]

Fleisler

[11] Patent Number: 4,470,400

[45] Date of Patent: Sep. 11, 1984

[54] FIREPLACE INSERT

[75] Inventor: Norman Fleisler, Laval, Canada

[73] Assignee: Powrmatic of Canada, Ltd., Quebec, Canada

[21] Appl. No.: 447,449

[22] Filed: Dec. 6, 1982

[51] Int. Cl.[3] ..... F24B 7/00

[52] U.S. Cl. ..... 126/121; 126/139; 126/77

[58] Field of Search ..... 126/121, 130, 131, 138, 126/139, 112, 77

[56] References Cited

U.S. PATENT DOCUMENTS

| | | | |
|---|---|---|---|
| 3,459,173 | 8/1969 | Lydle | 126/138 X |
| 4,008,704 | 2/1977 | Petrie . | |
| 4,122,824 | 10/1978 | Borgran . | |
| 4,187,829 | 2/1980 | Pauley . | |
| 4,197,829 | 4/1980 | Pierce . | |
| 4,204,519 | 5/1980 | Towery . | |
| 4,217,879 | 8/1980 | Comiskey . | |
| 4,219,005 | 8/1980 | Boahn | 126/139 X |
| 4,231,349 | 11/1980 | Livesay . | |
| 4,240,401 | 12/1980 | Chesnut et al. . | |
| 4,254,756 | 3/1981 | Wells . | |
| 4,266,526 | 5/1981 | Tolotti . | |
| 4,282,855 | 8/1981 | Perry | 126/138 X |
| 4,291,670 | 9/1981 | Hyatt . | |
| 4,297,986 | 11/1981 | Lehrer . | |
| 4,319,558 | 3/1982 | Thurlo . | |

*Primary Examiner*—Larry Jones

[57] ABSTRACT

The disclosure teaches a fireplace insert. The insert has a front surface having an openable see-through portion and fixed see-through portions on either side of the openable see-through portion. Warming air inlets are disposed below the fixed see-through portions, and combustion air inlets are disposed below the openable see-through portion. Bottom ducts are also provided, and each bottom duct has a front end and a rear end, the front ends being in communication with a respective one of the warming air inlets, the bottom ducts extending rearwardly horizontally behind the front surface. Cross ducts are one end thereof in communication with a respective one of the rear ends of the bottom ducts, and top ducts are disposed parallel to the bottom ducts and have front and rear ends. Pipe means communicate air from the bottom ducts to a respective one of the top ducts, and inverted L-shaped pipes, having front ends and rear ends, have the rear ends thereof connected to respective ones of the cross ducts. Plate means are disposed at the front surface over the see-through portions. The front ends of the inverted L-shaped pipes and the front ends of the top ducts are connected to the plate means at openings corresponding to the cross-sectional shape of the inverted L-shaped pipes and the top ducts respectively. Variable speed propeller-type fans are disposed behind the warming air inlet means, and control means are provided for varying the speed of the variable speed fans. Hood means are disposed at the top of the front surface over the plate and flare outwardly from the top downwards.

5 Claims, 4 Drawing Figures

Fig. 2
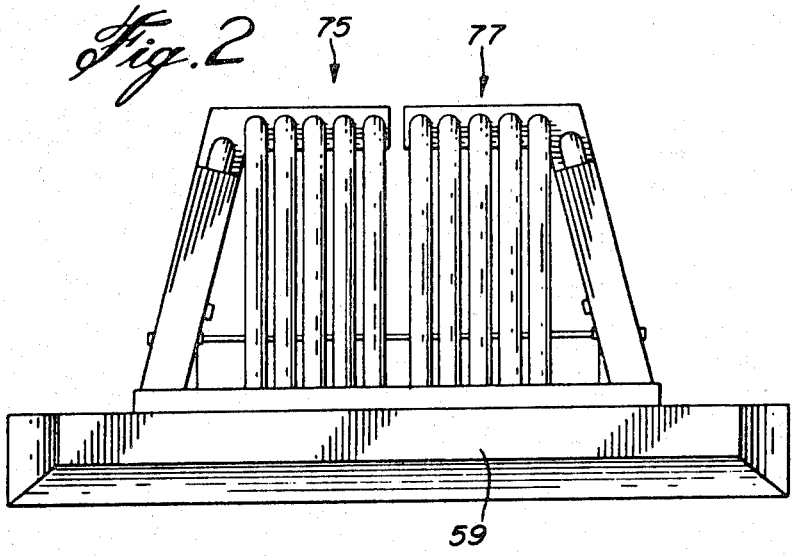
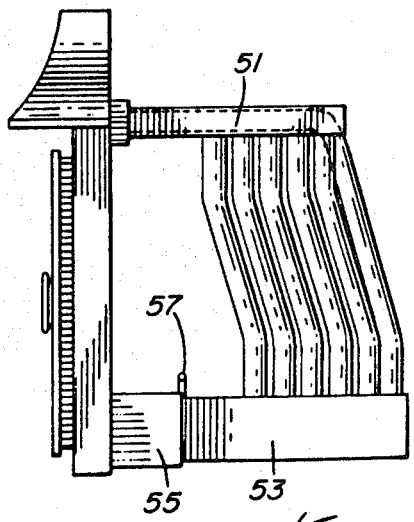
Fig. 3

FIREPLACE INSERT

BACKGROUND OF THE INVENTION (a) Field of the Invention

The invention relates to a fireplace insert. More specifically, the invention relates to such an insert which is efficient in warm air distribution and is therefore effective in conserving energy.

(b) Description of Prior Art

There are many fireplace inserts known in the prior art. Examples of said inserts are shown in: U.S. Pat. Nos. 4,008,704, Petrie, issued Feb. 22, 1977; 4,122,824, Borgran, issued Oct. 31, 1978; 4,187,829, Pauley, issued Feb. 12, 1980; 4,197,829, Pierce, issued Apr. 15, 1980; 4,204,519, Towery, issued May 27, 1980; 4,217,879, Comiskey, issued Aug. 19, 1980; 4,231,349, Livesay, issued Nov. 4, 1980; 4,240,401, Chesnut et al, issued Dec. 23, 1980; 4,254,756, Wells, issued Mar. 10, 1981; 4,266,526, Tolotti, issued May 12, 1981; 4,291,670, Hyatt, issued Sept. 29, 1981; 4,297,986, Lehrer, issued Nov. 3, 1981; and 4,319,558, Thurlo, issued Mar. 16, 1982. Examples of said inserts are also shown in Canadian Industrial Design Application No. 07-07-82-8, filed July 7, 1982, Powrmatic du Canada Ltee/Powrmatic of Canada Ltd. and U.S. Design Patent Application No. 363,667, filed Mar. 31, 1982, Norman Fleisler.

Although the patented inserts teach a great number of features, none of the inserts deal directly with the problem of conserving energy by more efficiently distributing warm air produced by the inserts.

SUMMARY OF THE INVENTION

It is therefore an object of the invention to provide a fireplace insert which overcomes problems of the known inserts.

It is a more specific object of the invention to provide such an insert which conserves energy by more efficiently distributing warm air produced by the insert.

In accordance with the invention there is provided a fireplace insert. The insert has a front surface having an openable see-through portion and fixed see-through portions on either side of the openable see-through portion. Warming air inlets are disposed below the fixed see-through portions, and combustion air inlets are disposed below the openable see-through portion. Bottom ducts are also provided, and each bottom duct has a front end and a rear end, the front ends being in communication with a respective one of the warming air inlets, the bottom ducts extending rearwardly horizontally behind the front surface. Cross ducts have one end thereof in communication with a respective one of the rear ends of the bottom ducts, and top ducts are disposed parallel to the bottom ducts and have front and rear ends. Pipe means communicate air from the bottom ducts to a respective one of the top ducts, and inverted L-shaped pipes, having front ends and rear ends, have the rear ends thereof connected to respective ones of the cross ducts. Plate means are disposed at the front surface over the see-through portions. The front ends of the inverted L-shaped pipes and the front ends of the top ducts are connected to the plate means at openings corresponding to the cross-sectional shape of the inverted L-shaped pipes and the top ducts respectively. Variable speed propeller-type fans are disposed behind the warming air inlet means, and control means are provided for varying the speed of the variable speed fans. Hood means are disposed at the top of the front surface over the plate and flare outwardly from the top downwards.

BRIEF DESCRIPTION OF DRAWINGS

The invention will be better understood by an examination of the following description, together with the accompanying drawings, in which:

FIG. 2 is a rear view of the inventive insert;

FIG. 3 is a side view of the inventive insert; and

DESCRIPTION OF PREFERRED EMBODIMENTS

A fireplace insert, indicated generally at 1, includes see-through portions 3 and 5. The see-through portions 3 comprise fixed glass panels, while the see-through portions 5 comprise outwardly opening doors with glass panels. As can be seen, the doors are centrally disposed while a fixed panel is disposed on either side of the openable doors.

Figure 4:
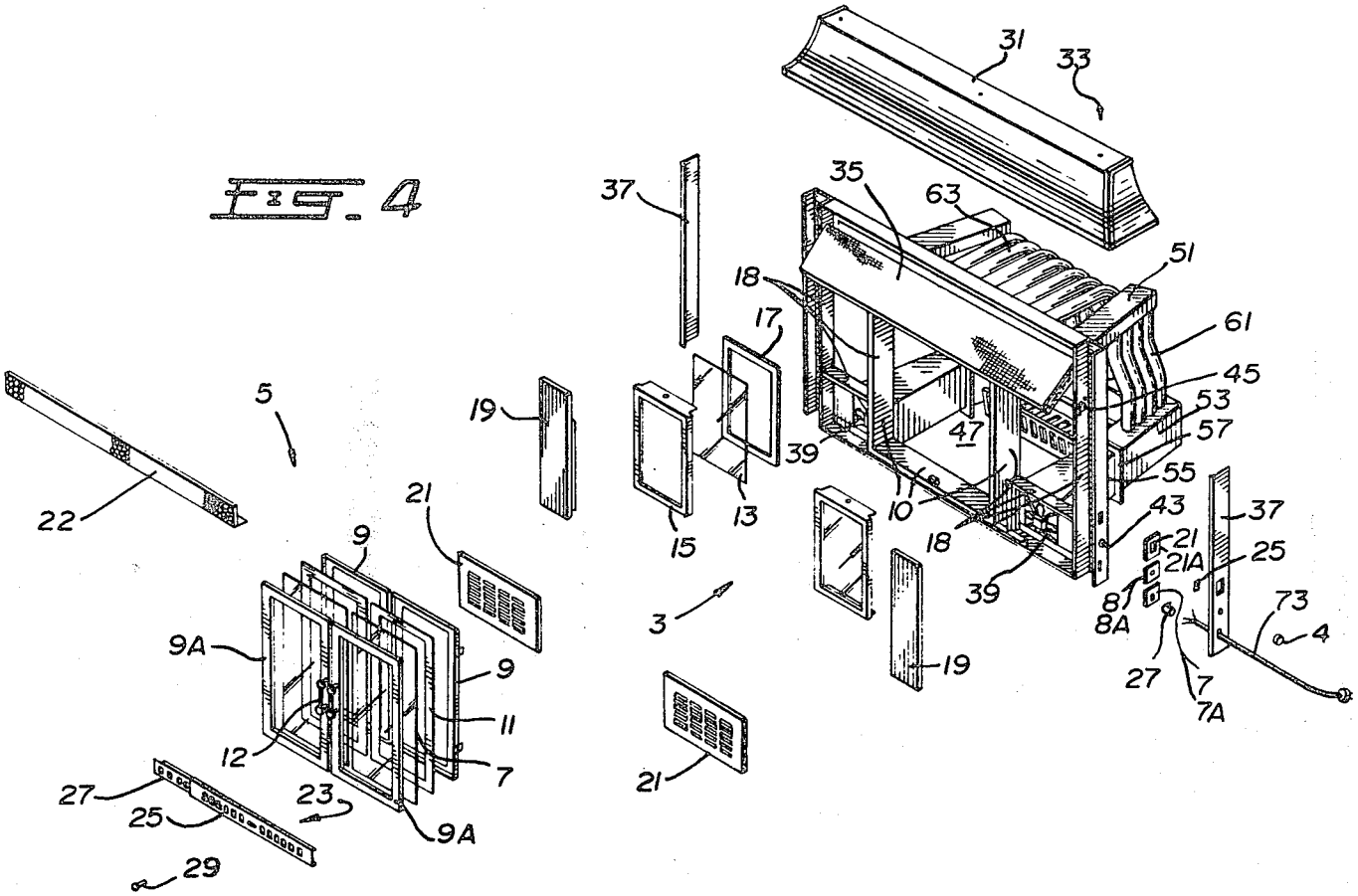
FIG. 4 is an exploded view of the inventive insert.

Referring now to FIG. 4, each openable door comprises a glass pane 7 and frames 9. A gasket 11 is disposed between the frames and the glass pane. The openable doors are mounted on main frame members 10. Each door includes a handle 12.

Each of the fixed glass panels includes a glass pane 13 and an outer frame 15. Gasket member 17 is disposed between the glass pane 13 and the members 18 of the insert frame.

Disposed on either side of the fixed panels are metallic panels 19. Disposed below the fixed panels are louvered warming air inlets 21. Disposed below the openable doors are adjustable combustion air inlets 23. As seen in FIG. 4, the combustion air inlets comprise portions 25 and 27 of which 27 is slidable in 25. Knob 29 is provided to permit adjustments of the combustion air inlet. As seen, each of the members 25 and 27 comprises a plurality of similar shaped openings. By moving the member 25 relative to 27, the number of openings which are not blocked, and the extent of these openings, is varied.

Disposed at the top of the front surface of the insert is a hood 31. As can be seen, the hood is flared outwardly from the top to the bottom for purposes which will be described below. The hood can be fastened to the main frame of the insert by screws 33.

Insulation layer 35 underlies the hood to prevent heating-up of the hood so that if a person comes in contact with the hood, they will not be burned.

Side panels 37 provide a finishing touch to the sides of the insert.

Disposed behind each louvered inlet 21 is a variable speed propeller-type warming air blower fan. The fans are driven by variable speed motor 40 which is adjustable by variable speed motor control 41. 43 is an ON-OFF switch for the motor 40, and the switch 43 and the control 41 comprise manual controls for the fans 39.

The fans are also controlled by the thermostats 45, as will be described below.

A combustion chamber 47 is defined by bottom ducts 49, top ducts 51, I-shaped pipes 61, and inverted L-shaped pipes 63. As can be seen, the bottom ducts consist of a fixed portion 55 and movable portions 53. The two are joined together by flanges 57. Because of this arrangement, it is possible to vary the depth of the insert.

The front ends of the inverted L-shaped pipes 63 and the top ducts 51 terminate in plate means 65 at openings which are similar to the cross-sectional shapes of the duct and pipes, respectively. Gasket means 67 are disposed between the insert and the fireplace, and a grate 69 could be included for carrying wood. A connector plug 71 receives a connecting mate with a wire for plugging into an AC outlet. Alternatively, such a wire with an AC outlet, for example, 73 in FIG. 4, could already be provided.

Turning to FIG. 3, it can be seen that the L-shaped pipes are divided in two sections and that the cross duct 59 is similarly divided in two sections.

As shown in FIG. 4, the fans 39 are disposed at the front ends of the ducts 49. The ducts 49 are in communication with respective ones of the ducts 51 through pipes 61, and, through duct 51, the ducts 49 are in communication with an opening in the plate 65.

Similarly, the ducts 49 are in communication with respective ones of the cross ducts 59 and, through respective ones of the inverted L pipes 63, the cross ducts are in communication, once again, with a respective opening in the plate 65.

Accordingly, cold air is drawn in through the warming air inlets and is then communicated, via various paths around the combustion chamber, to the openings in the plates 65. As the warming air passes through the ducts and the pipes, it is warmed by the heat of the combustion chamber, so that warm air is forced out through the openings in the plate 65.

Because of the shape of the hood, the warm air will be directed downwardly so that the entire height of a room in which the insert is disposed will be warmed.

Figure 1:
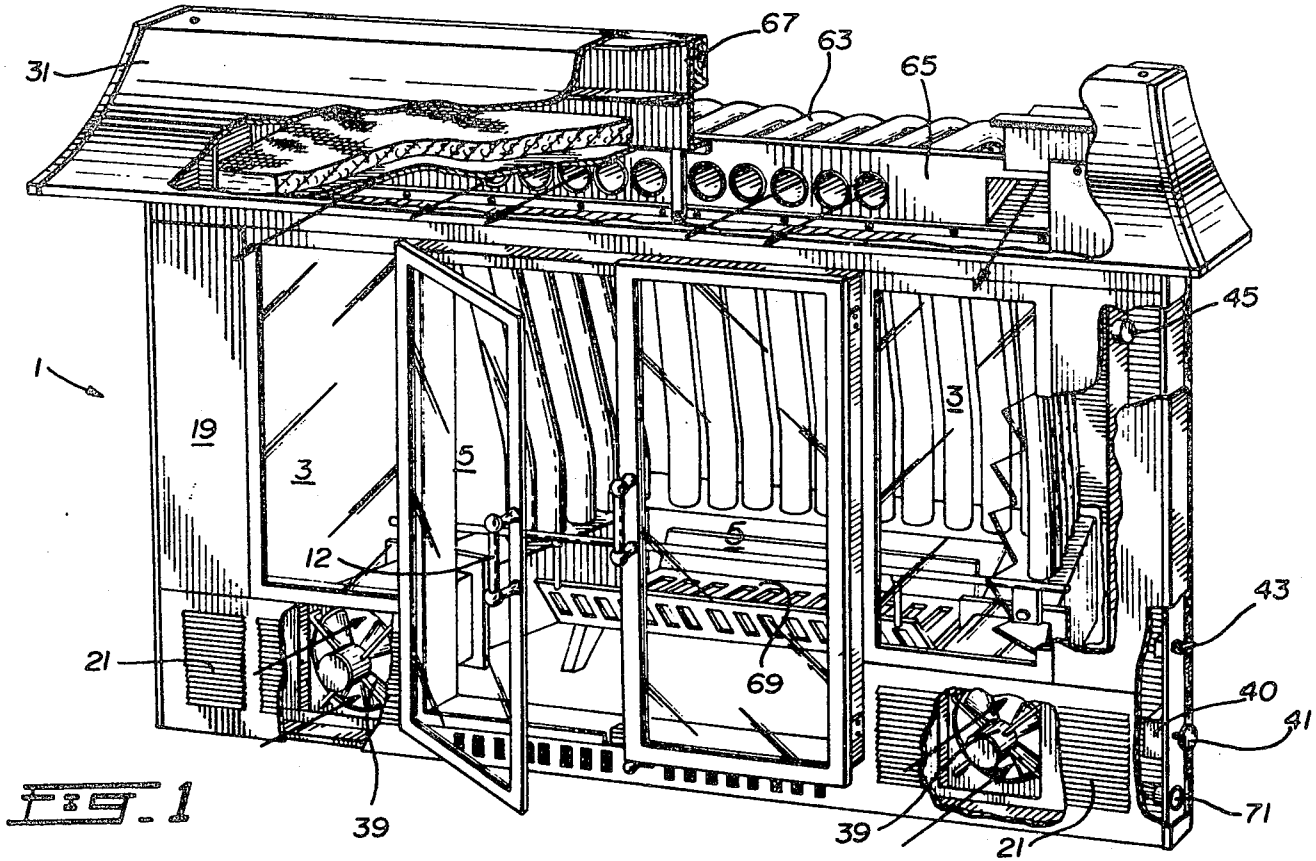
FIG. 1 is a perspective view of the inventive insert, partially broken away.

As seen in FIG. 1, the thermostat is disposed to sense the temperature in the warming air flow path. When the thermostat senses that the temperature is cold, it will keep the fans shut so as to avoid blowing cold air into the room.

As seen in FIGS. 1 and 4, the combustion air inlets 23 lead directly to the combustion chamber and will be drawn there by natural currents.

Because the warm air flow paths are in two sections, it is possible to adapt the insert to differently shaped fireplaces as required. In addition, it is possible for each section to act independently of the other.

The gaskets around the glass panes will accommodate thermal expansion of either the panes or the surrounding metallic frames to avoid damage to the sections during extreme temperature changes. At the same time, the gaskets will prevent the loss of heat which is usually experienced in known fireplace inserts. In the same way, the gasket seal between the insert and the fireplace allows for thermal expansion and seals in the heat so that warmed air is directed only in the desired directions.

It can therefore be seen that a fireplace in accordance with the invention conserves energy by more efficiently distributing warmed air.

Although a single embodiment has been described, this was for the purpose of illustrating, but not limiting, the invention. Various modifications, which will come readily to the mind of one skilled in the art, are within the scope of the invention as defined in the appended claims.

I claim:

1. A fireplace insert; comprising:

a front surface having an openable see-through portion and fixed see-through portions on either side of said openable see-through portion;

warming air inlets disposed below said fixed see-through portions;

combustion air inlet means disposed below said openable see-through portion comprising a first plate having a front face and a second plate having a front face, a plurality of spaced openings in said first faces of said first and second plates, the first plate being held in slidable engagement by the second plate, whereby said first plate is slidable relative to said second plate to thereby adjust the extent and number of said openings;

two bottom ducts, each disposed at a different side of the fireplace, each said bottom duct having a front end and a rear end, said front ends being in communication with a respective one of said warming air inlets, said bottom ducts extending rearwardly horizontally behind said front surface, each said bottom duct comprising a first pipe telescopically adjustably inserted in a second pipe, whereby said bottom ducts are adjustable in depth;

cross ducts having one end thereof in communication with a respective one of the rear ends of said bottom ducts;

top ducts parallel to said bottom ducts having front and rear ends;

pipe means for communicating air from said bottom ducts to a respective one of said top ducts;

inverted L-shaped pipes having front ends and rear ends, said rear ends of said inverted L-shaped pipes being connected to respective ones of said cross ducts;

plate means at said front surface over said see-through portions;

the front ends of said inverted L-shaped pipes and the front ends of said top ducts being connected to said plate means at openings corresponding to the cross-sectional shape of said inverted L-shaped pipes and said top ducts respectively;

variable speed propeller type fans disposed behind said warming air inlet means;

control means for varying the speed of said variable speed fans; and hood means disposed at the top of said front surface over said plate and flaring outwardly from the top downwards.

2. An insert as defined in claim 1, wherein said openable see-through means comprises outwardly openable doors;

each said door comprising:

a glass pane;

a frame means for framing said glass pane; and a gasket means disposed between said frame means and said glass pane.

3. An insert as defined in claim 1, wherein said fixed see-through means comprises two fixed panels, each of said fixed panels being disposed on one side of said openable see-through means;

each said fixed panel comprising:

a glass pane;

frame means for framing said glass pane; and gasket means between said glass pane and said frame means.

4. An insert as defined in claim 1 and further including insulation means disposed under said hood means.

5. An insert as defined in claim 1, wherein said cross duct means comprises two ducts;

each of said two ducts comprising:

a first end connected to a respective one of said bottom ducts and a second closed end.

* * * * *